US009643700B2

(12) United States Patent
Carroll

(10) Patent No.: US 9,643,700 B2
(45) Date of Patent: May 9, 2017

(54) SELECTIVELY SUBMERSIBLE VESSEL

(71) Applicant: Aerojet Rocketdyne, Inc., Sacramento, CA (US)

(72) Inventor: Joseph Carroll, Folsom, CA (US)

(73) Assignee: AEROJET ROCKETDYNE, INC., Rancho Cordova, CA (US)

( * ) Notice: Subject to any disclaimer, the term of this patent is extended or adjusted under 35 U.S.C. 154(b) by 0 days.

(21) Appl. No.: 15/002,423

(22) Filed: Jan. 21, 2016

(65) Prior Publication Data

US 2016/0236761 A1 Aug. 18, 2016

Related U.S. Application Data

(60) Provisional application No. 62/115,465, filed on Feb. 12, 2015.

(51) Int. Cl.

| | |
|---|---|
| ***B63G 8/08*** | (2006.01) |
| ***B63G 8/12*** | (2006.01) |
| ***B63G 8/22*** | (2006.01) |
| ***B63G 8/36*** | (2006.01) |
| *B63H 21/00* | (2006.01) |
| *B63G 8/00* | (2006.01) |

(52) U.S. Cl.

CPC ..... *B63G 8/12* (2013.01); *B63G 8/22* (2013.01); *B63G 8/36* (2013.01); *B63G 2008/004* (2013.01); *B63G 2008/005* (2013.01); *B63H 2021/006* (2013.01)

(58) Field of Classification Search

CPC ..... F01K 23/10; F01K 25/005; B63C 11/42; B63C 11/34; B63H 2021/006; B63G 2008/105; B63G 8/22; B63G 2008/004; B63G 8/36

See application file for complete search history.

(56) References Cited

U.S. PATENT DOCUMENTS

| | | | | |
|---|---|---|---|---|
| 3,062,000 A * | 11/1962 | Percival | B63G 8/10 | 126/400 |
| 3,757,722 A * | 9/1973 | Seiple | B63G 8/00 | 114/322 |
| 6,651,433 B1 * | 11/2003 | George, Jr. | B63G 8/12 | 60/614 |
| 2012/0290164 A1 * | 11/2012 | Hanson | B60F 5/00 | 701/23 |

* cited by examiner

*Primary Examiner* — Andrew Polay
(74) *Attorney, Agent, or Firm* — Joel G Landau

(57) ABSTRACT

A selectively submersible vessel includes a combustor, a Stirling engine thermally coupled with the combustor, an electric generator mechanically coupled with the Stirling engine, a rechargeable battery electrically connected with the electric generator, a compressor electrically coupled with the rechargeable battery, a ballast tank fluidly coupled with the compressor, a snorkel fluidly coupled with the compressor, a controller electrically connected with the rechargeable battery, at least one sensor electrically connected with the controller, a data storage device electrically connected with the controller, and a data communications device electrically connected with the controller.

12 Claims, 1 Drawing Sheet

SELECTIVELY SUBMERSIBLE VESSEL

REFERENCE TO RELATED APPLICATIONS

This application claims priority to U.S. Provisional Application No. 62/115,465, filed on Feb. 12, 2015.

BACKGROUND

Submersible vessels may be manned or unmanned. Unmanned vessels may contain sensors and other components for data collection. Many unmanned vessels include a propulsion system that can move the vessel from location to location for data collection. Propulsion systems generate sound, which may be subject to detection and to potentially disturbing the environment around the vessel. Alternatively, an unmanned vessel may be towed behind a vehicle if the vessel does not have a propulsion system, which again may be subject to detection and to potentially disturbing the environment around the vessel. Other types of unmanned vessels, which do not include a propulsion system or that are not towed, are typically completely static. Such vessels are deployed at a desired location and later retrieved. Although such vessels may be less subject to detection or to disturbing the surrounding environment, the period of operation is limited.

SUMMARY

A selectively submersible vessel according to an example of the present disclosure includes a combustor, a Stirling engine thermally coupled with the combustor, an electric generator mechanically coupled with the Stirling engine, a rechargeable battery electrically connected with the electric generator, a compressor electrically coupled with the rechargeable battery, a ballast tank fluidly coupled with the compressor, a snorkel fluidly coupled with the compressor, a controller electrically connected with the rechargeable battery, at least one sensor electrically connected with the controller, a data storage device electrically connected with the controller, and a data communications device electrically connected with the controller.

A further embodiment of any of the foregoing embodiments includes a fuel tank and a fuel pump in fluid communication with the fuel tank and the combustor.

In a further embodiment of any of the foregoing embodiments, the combustor, the Stirling engine, the electric generator, the rechargeable battery, the compressor, and the ballast tank are contained within an elongated vessel housing.

In a further embodiment of any of the foregoing embodiments, the combustor, the Stirling engine, the electric generator, the rechargeable battery, the compressor, and the ballast tank are serially arranged between opposed first and second ends of the elongated vessel housing.

In a further embodiment of any of the foregoing embodiments, the ballast tank is arranged closer to the first end than to the second end.

In a further embodiment of any of the foregoing embodiments, of the combustor, the Stirling engine, the electric generator, the rechargeable battery, the compressor, and the ballast tank, the ballast tank is closest to the first end.

A further embodiment of any of the foregoing embodiments includes a tether operable to moor the vessel.

In a further embodiment of any of the foregoing embodiments, the controller is configured to collect data via the at least one sensor and store the data in the data storage device.

In a further embodiment of any of the foregoing embodiments, the controller is configured to transmit data from the data storage device via the communications device.

In a further embodiment of any of the foregoing embodiments, the controller is configured to manage buoyancy via either charging the ballast tank with water to reduce buoyancy or charging the ballast tank with air via the compressor to increase buoyancy.

In a further embodiment of any of the foregoing embodiments, the controller is configured to charge the rechargeable battery by activating the compressor to provide air to the combustor to generate heat in the Stirling engine such that the Stirling engine drives the electric generator and provides electric current to the rechargeable battery.

A selectively submersible vessel according to an example of the present disclosure includes a combustor, a Stirling engine, an electric generator, a rechargeable battery, a compressor, a ballast tank, a snorkel, at least one sensor, a data storage device, a data communications device, and a controller. The controller is configured with one or more of a plurality of control modes that include Mode 1, Mode 2, Mode 3, and Mode 4. In Mode 1, the controller is configured to collect data via the at least one sensor and store the data in the data storage device. In Mode 2, the controller is configured to transmit the data from the data storage device via the communications device. In Mode 3, the controller is configured to manage buoyancy via either charging the ballast tank with water to reduce buoyancy or charging the ballast tank with air via the compressor to increase buoyancy. In Mode 4, the controller is configured to charge the rechargeable battery by activating the compressor to pump air to the combustor to generate heat in the Stirling engine such that the Stirling engine drives the electric generator and provides electric current to the rechargeable battery.

In a further embodiment of any of the foregoing embodiments, in the Mode 4, the compressor draws the air from the snorkel.

In a further embodiment of any of the foregoing embodiments, in the Mode 4, the compressor draws the air from the ballast tank.

A further embodiment of any of the foregoing embodiments includes a fuel tank and a fuel pump in fluid communication with the fuel tank and the combustor.

In a further embodiment of any of the foregoing embodiments, the combustor, the Stirling engine, the electric generator, the rechargeable battery, the compressor, and the ballast tank are contained within an elongated vessel housing.

In a further embodiment of any of the foregoing embodiments, the combustor, the Stirling engine, the electric generator, the rechargeable battery, the compressor, and the ballast tank are serially arranged between opposed first and second ends of the elongated vessel housing.

In a further embodiment of any of the foregoing embodiments, the ballast tank is arranged closer to the first end than to the second end.

In a further embodiment of any of the foregoing embodiments, of the combustor, the Stirling engine, the electric generator, the rechargeable battery, the compressor, and the ballast tank, the ballast tank is closest to the first end.

A further embodiment of any of the foregoing embodiments includes a tether operable to moor the vessel.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
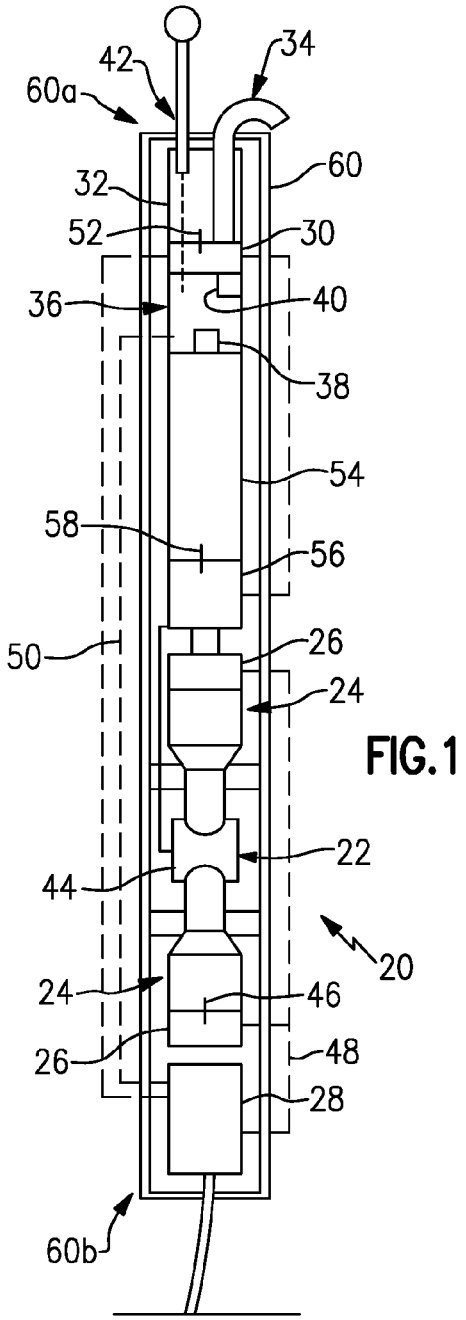
FIG. 1 illustrates an example of a selectively submersible vessel.

FIG. 1 schematically illustrates an example of a submersible vessel 20.

The vessel 20 is an unmanned, autonomous vessel, i.e., the vessel 20 is fully operable according to programmed instructions and contains all the necessary components for long term operation without human intervention. As can be appreciated, the vessel 20 may include additional components, but as shown the vessel 20 generally includes a combustor 22, at least one Stirling engine 24 (two shown), at least one electric generator 26 (two shown), a rechargeable battery 28, a compressor 30, a ballast tank 32, a snorkel 34, and a controller 36. The controller 36 is electrically connected with at least one sensor 38, one or more data storage devices 40, and one or more data communication devices 42. The sensor 38 in this example is an internal sensor inside of the vessel 20, but the sensor 38, or additional sensors 38, may be external or at least partially external.

Each Stirling engine 24 is thermally coupled with the combustor 22, such as at thermal interface 44. For instance, the thermal interface 44 can be a common wall or other interface that is readily thermally conductive, such a metallic wall or walls. Each electric generator 26 is mechanically coupled, as represented at 46, with a corresponding one of the Stirling engines 24.

The rechargeable battery 28 is electrically connected with the electric generators 26, as shown at line 48. The compressor 30 is electrically coupled with the rechargeable battery 28 as shown at line 50, and the ballast tank 32 is fluidly coupled at 52 with the compressor 30. The snorkel 34 is also fluidly coupled with the compressor 30. Fluidly coupled components may also include one or more valves or metering devices to control flow between the components. In this example, the vessel 20 also includes a fuel tank 54 and a fuel pump 56 that is in fluid communication at 58 with the fuel tank 54. For instance, the fuel may be, but is not limited to, JP-8 or diesel fuel.

In the example shown, at least the Stirling engine or engines 24, the electric generator or generators 26, the rechargeable battery 28, the compressor 30, and the ballast tank 32 are contained within a vessel housing 60. The vessel housing 60 is generally elongated and cylindrical. Rather than cylindrical, the vessel housing 60 could alternatively have a different cross-sectional shape as appropriate to house the components.

For compactness, the Stirling engine or engines 24, the electric generator or generators 26, the rechargeable battery 28, the compressor 30, and the ballast tank 32 are arranged serially between opposed first and second ends 60*a* and 60*b* of the vessel housing 60. Furthermore, for buoyancy and to orient the vessel 20 vertically when floating, the ballast tank 32 is arranged to be closer to the first end 60*a* than to the second end 60*b*. For example, as shown, the ballast tank 32 is closest to the first end 60*a* among the above-mentioned components.

The controller 36 may include software, hardware (such as one or more microprocessors), or both for carrying out any of the methodologies or functions described herein. Generally, the vessel 20 may be used for data collection in underwater operations. In this regard, the one or more sensors 38 are operable to collect data relating to external conditions around the vessel 20. For example, the one or more sensors 38 may include thermal sensors, optical sensors, acoustic sensors, or other sensors that are operable to detect external conditions and communicate data about such external conditions to the data storage device 40. The controller 36 may, at predefined intervals, communicate the data via the data communication device 42 to an external source, such as but not limited to, a satellite or ground based source. In this regard, the communication device 42 may at least include a transmitter that is operable to transmit the data by radio waves, for example. The communication device 42 may additionally include a receiver (e.g., in a transceiver) that is operable to receive radio waves.

The controller 36 also controls operation of the vessel 20 with regard to various control modes for autonomous operation. The control modes may include one or more of Mode 1, Mode 2, Mode 3, or Mode 4. In Mode 1, the controller 36 is configured to collect data via the sensor or sensors 38 and store the data in the data storage device 40. In Mode 2, the controller 36 is configured to transmit the data from the data storage device 40 via the communications device 42. In Mode 3, the controller 36 is configured to manage buoyancy of the vessel 20 via either charging the ballast tank 32 with water to reduce buoyancy or charging the ballast tank 32 with air via the compressor 30 to increase buoyancy. In Mode 4, the controller 36 is configured to charge the rechargeable battery 28 by activating the compressor 30 to pump air to the combustor 22 to generate heat in the Stirling engine or engines 24 such that the Stirling engine or engines 24 drive the electric generator or generators 26 and provide electric current to the rechargeable battery 28.

For example, the Stirling engine 24 is a heat engine that operates by cyclic compression and expansion of air or other working fluid at different temperatures such that the heat energy from the combustor 22 is converted to mechanical work. In turn, the mechanical work is used to drive the electric generator or generators 26 to produce electric current. In this regard, the Stirling engine or engines 24 are closed-cycle systems that do not rely upon external working fluids, i.e., the working fluid is permanently contained within the engine.

Figure 2:
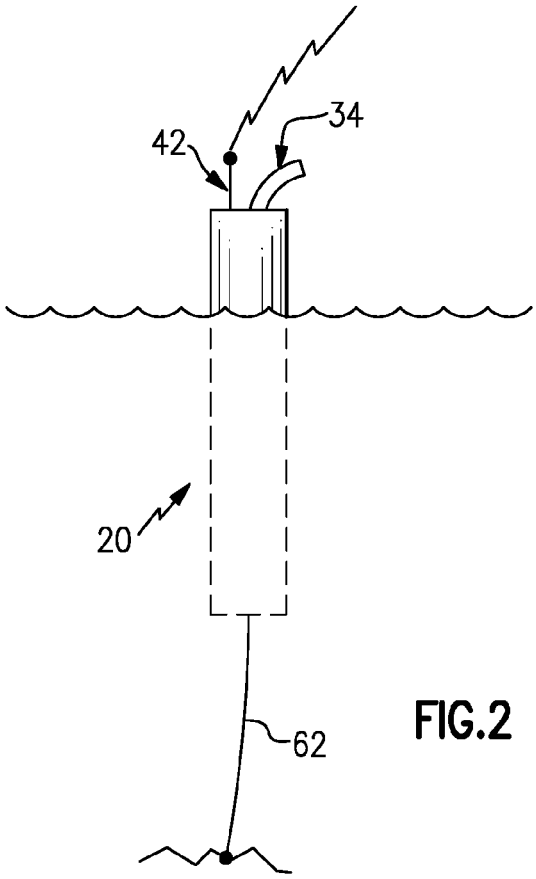
FIG. 2 illustrates an example of a selectively submersible vessel in a buoyant state at or near the water surface.
Figure 3:
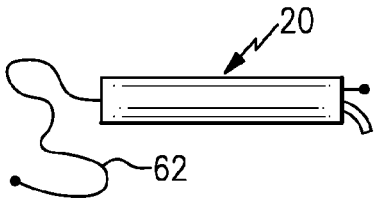
FIG. 3 illustrates an example of a submersible vessel at rest on a sea floor.

FIGS. 2 and 3 illustrate the vessel 20 during different stages of a mission in which the vessel 20 utilizes the aforementioned control modes for autonomous operation. For example, the vessel 20 can be deployed into the ocean and moored to the sea floor via a tether 62. When the ballast tank 32 is charged with air the vessel 20 is buoyant and is partially above the ocean surface, or at least near the ocean surface. While at or near the ocean surface the controller 36, while in Mode 2, may transmit the data from the data storage device 40 via the communications device 42 to the external source. Upon completion of data transmission, the controller 36, in Mode 3, may manage buoyancy of the vessel 20 to reduce buoyancy by charging the ballast tank 32 with water to submerge the vessel 20. For example, the vessel 20 may submerge to the sea floor, as shown in FIG. 3. After a period of data collection on the sea floor, the controller, again in Mode 3, may manage buoyancy of the vessel 20 to increase buoyancy by charging the ballast tank 32 with air to passively raise the vessel 20 to the surface for another iteration of data transmission.

While at rest on the sea floor, or even in a buoyant state, relatively little power is used from the rechargeable battery 28. For example, power may be drawn only to run the controller 36, the one or more sensors 38, and the storage device 40 to collect the data. However, once the power level of the rechargeable battery 28 is drained or falls below a predefined threshold, the controller 36, in Mode 4, may charge the rechargeable battery 28. The operation of the Stirling engine or engines 24 drives the electric generator or generators 26 and thus provides electric current to charge or recharge the rechargeable battery 28. Once charged to a predefined level of charge, the controller 36 may cease the recharging operation and return to a low power state in which the Stirling engine or engines 24 are inactive.

In further examples, in Mode 4 to charge the rechargeable battery 28, the air for combustion may be provided from either the snorkel 34 or the ballast tank 32. For example, if the vessel 20 is at the surface as shown in FIG. 2, the controller 36 may command the compressor 30 to draw air through the snorkel 34 to provide to the combustor 22. If the vessel 20 is not at the surface, the controller 36 may, in Mode 3, manage buoyancy to raise the vessel 20 to the surface for recharging. However, if the vessel 20 is submerged such that the snorkel 34 is below the surface, the controller 36 may alternatively command the compressor 30 to draw air from the ballast tank 32 to provide to the combustor 22. In this regard, one or more of the sensors 38 may be a sensor that is operable to detect whether the snorkel 34 is above or below the surface.

As will be appreciated from the above disclosure, the vessel 20 is reliable, quiet, and efficient. For instance, the Stirling engine or engines 24 provide the ability to restart after long periods of dormancy because the Stirling engine or engines 24 are hermetically sealed and thus are not susceptible to fuel fouling or engine wet stacking. In this regard, the vessel 20 may reside on the sea floor for weeks, months, or even years until the rechargeable battery is low on power. While at rest, the vessel 20 is relatively quiet because there are no mechanical operations and the operation of the controller 36, sensors 38, and storage device 40 may be the only ongoing electrical operations during this period. Thus, the period of autonomous operation of the vessel 20 is only limited by the amount of fuel carried in order to periodically recharge the rechargeable battery 28.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A selectively submersible vessel comprising:
- a combustor;
- a Stirling engine thermally coupled with the combustor;
- an electric generator mechanically coupled with the Stirling engine;
- a rechargeable battery electrically connected with the electric generator;
- a compressor electrically coupled with the rechargeable battery;
- a ballast tank fluidly coupled with the compressor;
- a snorkel fluidly coupled with the compressor;
- a controller electrically connected with the rechargeable battery;
- at least one sensor electrically connected with the controller;
- a data storage device electrically connected with the controller; and
- a data communications device electrically connected with the controller,
- wherein the rechargeable battery, the Stirling engine, the compressor, and the ballast tank are contained within an elongated vessel housing, and
- wherein the rechargeable battery, the Stirling engine, the compressor, and the ballast tank are serially arranged between opposed first and second ends of the elongated vessel housing, and
- wherein the ballast tank is arranged closer to the first end than to the second end.

2. The vessel as recited in claim 1, further comprising a fuel tank and a fuel pump in fluid communication with the fuel tank and the combustor.

3. The vessel as recited in claim 1, further comprising a tether operable to moor the vessel.

4. The vessel as recited in claim 1, wherein the controller is configured to collect data via the at least one sensor and store the data in the data storage device.

5. The vessel as recited in claim 1, wherein the controller is configured to transmit data from the data storage device via the communications device.

6. The vessel as recited in claim 1, wherein the controller is configured to manage buoyancy via either charging the ballast tank with water to reduce buoyancy or charging the ballast tank with air via the compressor to increase buoyancy.

7. The vessel as recited in claim 1, wherein the controller is configured to charge the rechargeable battery by activating the compressor to provide air to the combustor to generate heat in the Stirling engine such that the Stirling engine drives the electric generator and provides electric current to the rechargeable battery.

8. A selectively submersible vessel comprising:
- a combustor,
- a Stirling engine,
- an electric generator,
- a rechargeable battery,
- a compressor,
- a ballast tank,
- a snorkel,
- at least one sensor,
- a data storage device,
- a data communications device, and
- a controller,
- wherein the rechargeable battery, the Stirling engine, the compressor, and the ballast tank are contained within an elongated vessel housing, and
- wherein the rechargeable battery, the Stirling engine, the compressor, and the ballast tank are serially arranged between opposed first and second ends of the elongated vessel housing, and
- wherein the ballast tank is arranged closer to the first end than to the second end,
- wherein the controller is configured with one or more of a plurality of control modes including Mode 1, Mode 2, Mode 3, and Mode 4, wherein: in Mode 1, the controller is configured to collect data via the at least one sensor and store the data in the data storage device, in Mode 2, the controller is configured to transmit the data from the data storage device via the communications device, in Mode 3, the controller is configured to manage buoyancy via either charging the ballast tank with water to reduce buoyancy or charging the ballast tank with air via the compressor to increase buoyancy, and in Mode 4, the controller is configured to charge the rechargeable battery by activating the compressor to pump air to the combustor to generate heat in the Stirling engine such that the Stirling engine drives the electric generator and provides electric current to the rechargeable battery.

9. The vessel as recited in claim 8, wherein, in the Mode 4, the compressor draws the air from the snorkel.

10. The vessel as recited in claim 8, wherein, in the Mode 4, the compressor draws the air from the ballast tank.

11. The vessel as recited in claim 8, further comprising a fuel tank and a fuel pump in fluid communication with the fuel tank and the combustor.

12. The vessel as recited in claim 8, further comprising a tether operable to moor the vessel.

* * * * *